United States Patent [19]

Fann et al.

[11] Patent Number: 5,074,605

[45] Date of Patent: Dec. 24, 1991

[54] DUPLEX LATCH-BOLT MECHANISM

[75] Inventors: Yaw-Shin Fann, Chia-Yi; San-Yi Lin, Yun-Lin Hsien; Ching-Chuan Kuo, Chia-Yi Hsien; Ming-Shyang Chiou, Chia-Yi, all of Taiwan

[73] Assignee: Tong-Lung Metal Industry Co., Ltd., Taiwan

[21] Appl. No.: 329,434

[22] Filed: Mar. 28, 1989

[51] Int. Cl.[5] ..... F05C 1/16

[52] U.S. Cl. ..... 292/337; 292/169.14; 292/1.5

[58] Field of Search ..... 292/1, 337, 1.5, 169, 292/169.14, 169.13, 169.23, 169.24, DIG. 60

[56] References Cited

U.S. PATENT DOCUMENTS

| | | | |
|---|---|---|---|
| 1,661,454 | 3/1928 | Wilson | 292/DIG. 74 X |
| 4,575,137 | 3/1986 | Jans | 292/337 X |
| 4,615,549 | 10/1986 | Couture | 292/169.21 |
| 4,711,477 | 12/1987 | Fann et al. | 292/169.14 |
| 4,746,154 | 5/1988 | Fang | 292/1 X |
| 4,750,766 | 6/1988 | Shen | 292/337 |
| 4,804,216 | 2/1989 | Marotto | 292/1 X |
| 4,850,626 | 7/1989 | Gallego | 292/1 X |
| 4,890,871 | 1/1990 | Lin | 292/337 |

*Primary Examiner*—Eric K. Nicholson
*Attorney, Agent, or Firm*—Ashen Martin Seldon Lippman & Scillieri

[57] ABSTRACT

An improved duplex latch-bolt mechanism is composed of a latch-bolt head assembly and a latch-bolt transfer device adapted to make a selectable connection with a standard latch-handle assembly having a square transfer member and a pair of cylindrical support nuts provided for use in a door fitting arrangement. The latch-bolt transfer device includes: a bolt extracting member with a central open section connected to the latch-bolt head assembly; an upper coupling member and a lower coupling member, connected around the extracting member, each formed with a plurality of selectable openings; a displacement member with a cam through opening ajustably joined with the upper and lower coupling members for being operated to define two selectable positions along with the upper and lower coupling members according to the door fitting arrangement; a cam setting device movably disposed in the open section of the bolt extracting member for being connected to the square transfer member during the performance of locking and unlocking operations; and a transfer locking member disposed on the displacement member for keeping the cam setting device in position.

6 Claims, 21 Drawing Sheets

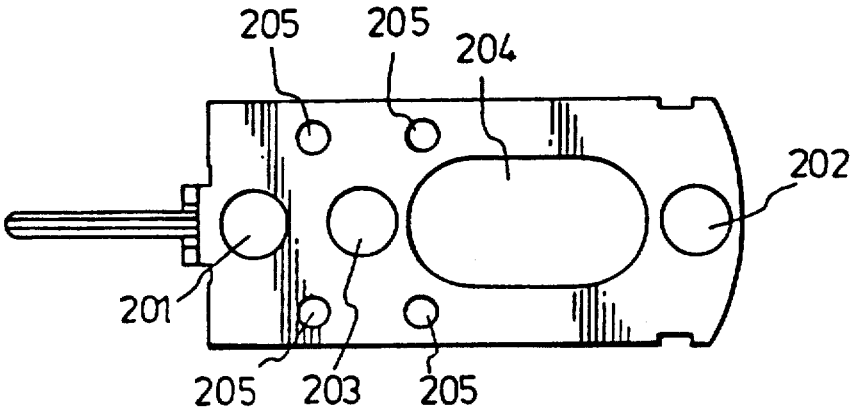
FIG. 4A
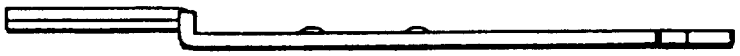
FIG. 4B
FIG. 5A
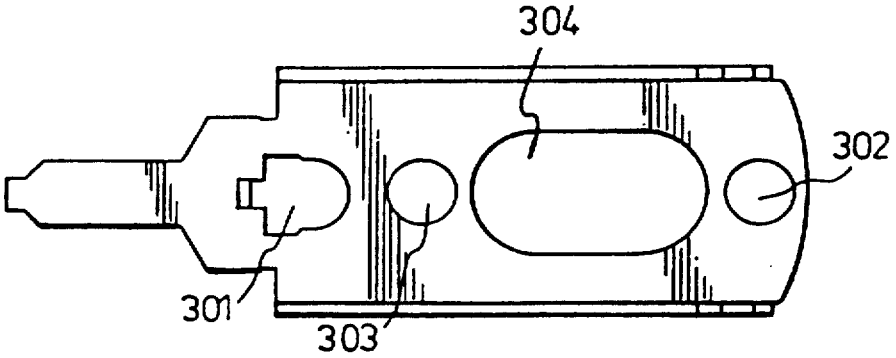
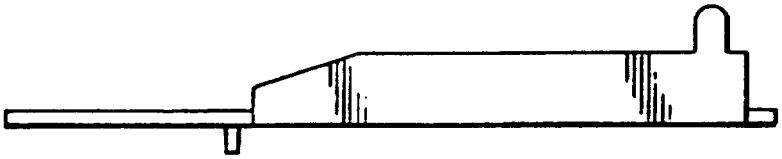
FIG. 5B

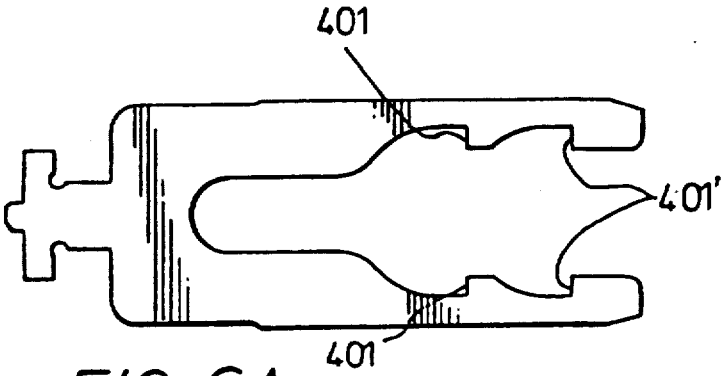
FIG. 6A
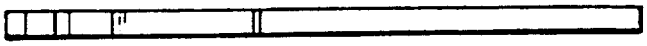
FIG. 6B
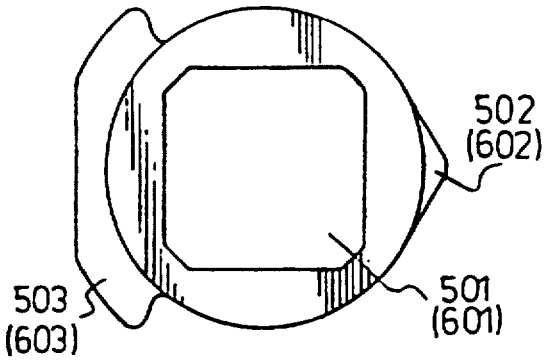
FIG. 7A
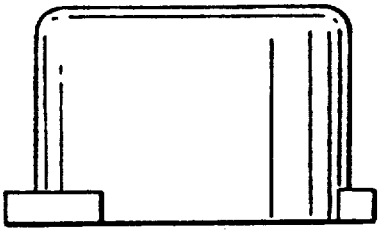
FIG. 7B
FIG. 8A
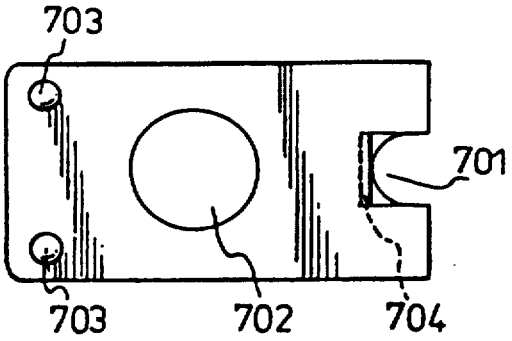
FIG. 8B
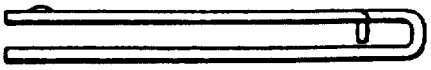

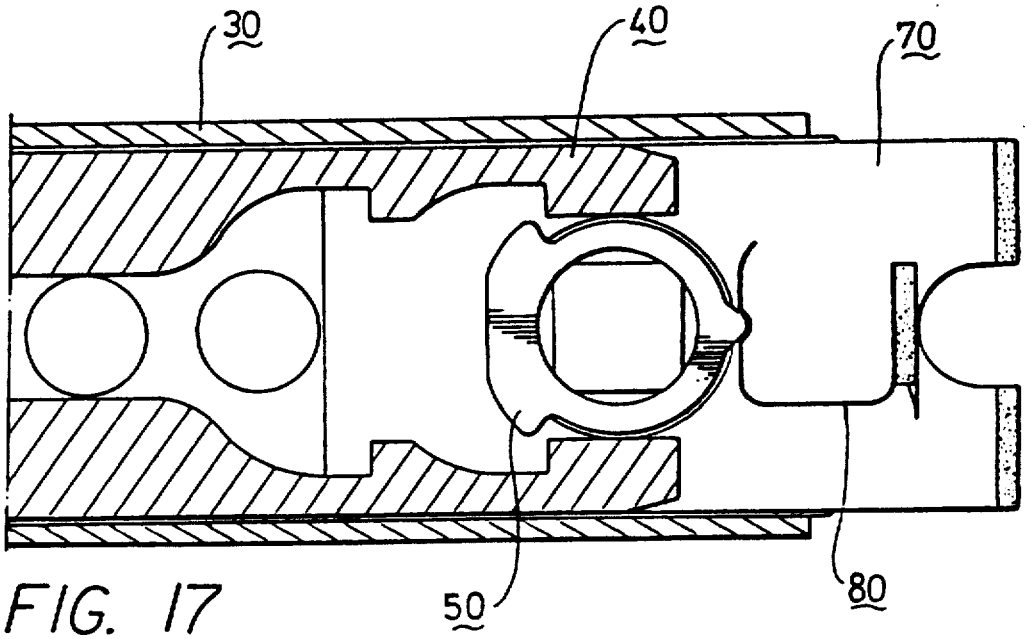
FIG. 17
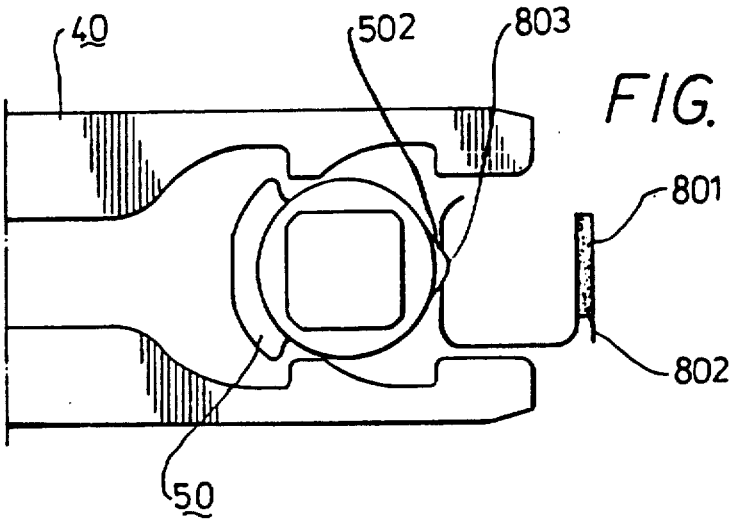
FIG. 18A
FIG. 18B
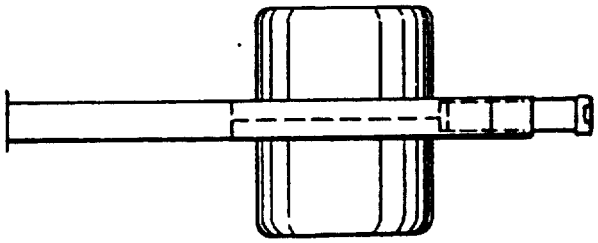

DUPLEX LATCH-BOLT MECHANISM

BACKGROUND OF THE INVENTION

This invention relates to an improved duplex latch-bolt mechanism having an adjustable cam device and a displacement jacket assembly adapted to enable the latch-bolt mechanism to be conveniently adjusted for any door fitting arrangement.

Traditionally, latch-bolt mechanisms used in known cylinder door locks are usually confined to two kinds of backset configurations—namely, a 60 mm type and a 70 mm type backset configurations. As ordinary consumers, however, are unaware of this situation, a great deal of inconvenience has been caused in the installation of door locks either by the need to change to another type of door lock or by the need to make mechanical modifications to the latch-bolt mechanism of the unsuitable door lock. In consideration of this problem, studies and improvements have been made to provide a duplex latch-bolt mechanism adapted to both the 60 mm and 70 mm backset configurations. Typical products of this latch-bolt mechanism are generally classified into the following two types:

1) A fixed duplex latch-bolt mechanism in whichthe length of the latch-bolt mechanism 1, as shown in FIG. 1(A), is fixed for a 60 mm as well as for a 70 mm door fitting arrangement. Although this kind of latch-bolt mechanism can be adaptable to a door lock arrangement without requiring a mechanical modification of the latch bolt itself, problems still exist. As shown in FIG. 1(B), when the door lock arrangement 8 (i.e. the installation distance provided from the door post edge 6 to the central point of the lock opening 7 in the door), is made for installing a 60 mm type latch-bolt mechanism, the length of the latch-bolt mechanism 1 will exceed a distance 9 of the lock opening 7. Consequently, the door lock opening 7 in the door has to be re-drilled to a greater depth 10 so as to accommodate the entire length of the fixed duplex latch-bolt mechanism 1, causing a certain inconvenience in the installation process.

2.) An adjustable duplex latch-bolt mechanism in which the length of the latch bolt mechanism 2, as shown in FIG. 2, is fixed for a 60 mm door fitting arrangement, and depending on the requirements of the installation conditions, an adjustment from the latch-bolt mechanism can be made to adapt to a 70 mm door fitting arrangement. Although this kind of latch-bolt mechanism has overcome the shortcoming suffered by the fixed duplex latch-bolt mechanism as mentioned in 1), above, difficulty often occurs in making said adjustment. As can be seen in FIG. 2, when making an adjustment to the latch-bolt mechanism 1', a shifting sleeve 3 has to be pulled out to re-align the positioning openings 31 with the transfer openings 111, 51 (41), and 121 in said latch-bolt mechanism 1'. Since no positioning fittings are provided on the shifting sleeve 3, it is not only inconvenient for the user to hold the shifting sleeve 3 in position, but said sleeve 3 also frequently comes off during the removal operation. In addition, to dispose the two transfer gears 4, 5 in the limited space of the latch-bolt mechanism 1' also introduces some difficulty to the manufacturing process.

In addition, a known dual backset latch was disclosed in Taiwan under Patent Publication No. 82244 on Nov. 1, 1986, which corresponds to U.S. application No. 639,715 filed Aug. 4, 1984 now U.S. Pat. No. 4,615,549. The problems of the disclosed invention are as follows:

1) The entire structure of this backset latch is designed to adapt to a special latch-handle assembly wherein cylindrical support nuts as normally provided in the known art are not used. Therefore, this backset latch requires a specific latch-handle assembly, a requirement which is both inefficient and uneconomic.

2) Since the front and rear cams of the backset latch are both C-shaped, the unlocking operation of the backset latch is always undertaken by the three sides of said cams, resulting in considerable unstability and wear thereof.

In order to solve the problems suffered by the prior art, the applicant has specifically designed a duplex latch-bolt mechanism which can be adapted to any door fitting arrangement by a mere adjustment, the application for which was filed on Jan. 7, 1986 in the U.S. under Ser. No. 817,422, and the patent for which was granted on Dec. 8, 1987 under U.S. Pat. No. 4,711,477. However, since the above-mentioned patent was designed for those cylinder door locks adaptable only to a unique curved transfer member, efforts were made to develop another novel structure for cylinder door locks with a square transfer member.

SUMMARY OF THE INVENTION

It is accordingly a primary object of the present invention to provide an improved duplex latch-bolt mechanism with a displacement means by which length adjustment of the latch-bolt mechanism can be easily made for satisfying a 60 mm or a 70 mm door fitting arrangement.

It is another object of the present invention to provide an improved duplex latch-bolt mechanism with a cam setting arrangement for being operated by a square transfer member of an ordinary latch-handle assembly.

These and other objects of the present invention are achieved by providing an improved duplex latch-bolt mechanism which is a combination of a latch-bolt head assembly and a latch-bolt transfer device connected to the latch-bolt head assembly. The structure of the latch-bolt head assembly is identical to that of a known art, and the latch-bolt transfer device according to the present invention is composed of an upper coupling member, a lower coupling member, a bolt extracting member, a cam setting means, a displacement means, and a transfer locating member. The bolt extracting member which is formed with an open section and a plurality of forward and rear teeth on the opposing edge of the open section is movably connected to the latch-bolt head assembly; the upper coupling member and the lower coupling member which each has a plurality of screw openings and a cam through opening, are fixed around the bolt extracting member; the displacement means formed with a screw opening and a central opening is coupled with the upper coupling member; the cam setting means are movably disposed in the open section of the bolt extracting member in conjunction with the forward and rear teeth thereof and in communication with cam through openings of the upper and lower coupling members as well as with the central opening of the displacement means; and the transfer locating member is disposed on top of the displacement means with respect to the cam setting means. The combined duplex latch-bolt mechanism is transversely connected to an ordinary latch-handle assembly, through a square transfer member and a plurality of cylindrical support nuts, for being operated to perform locking and unlocking operations. The length of the latch-bolt mechanism can be easily adjusted to a 60 mm or a 70 mm configuration for satisfying different door fitting arrangements.

Other advantages and characteristics of the present invention will become apparent from the following detailed descriptions which, when taken in conjunction with the annexed drawings, disclose a preferred embodiment of the present invention.

BRIEF DESCRIPTION OF THE DRAWINGS

FIGS. 4*a* and 4*b* are respectively a plan view of an upper coupling member of the preferred embodiment shown in FIG. 3 and an elevation thereof;

FIGS. 5*a* and 5*b* are respectively a plan view of a lower coupling member of the preferred embodiment shown in FIG. 3 and an elevation thereof;

FIGS. 6*a* and 6*b* are respectively a plan view of a bolt extracting member the preferred embodiment shown in FIG. 3 and an elevation view thereof;

FIGS. 7*a* and 7*b* are respectively a plan view of a combined cam setting means of the preferred embodiment shown in FIG. 3 and an elevation view thereof;

FIGS. 8*a* and 8*b* are respectively a plan view of a displacement means of the preferred embodiment shown in FIG. 3 and an elevation view thereof;

FIG. 17 is a sectional view of the latch-bolt transfer device taken along line L'—L" of FIG. 16;

FIGS. 18*a* and 18*b* are respectively plan and elevation view schematically illustrating the positioning condition of the assembled cam setting means and the transfer locating member of the preferred embodiment shown in FIG. 3;

DETAILED DESCRIPTION OF THE PREFERRED EMBODIMENT

Figure 1A:
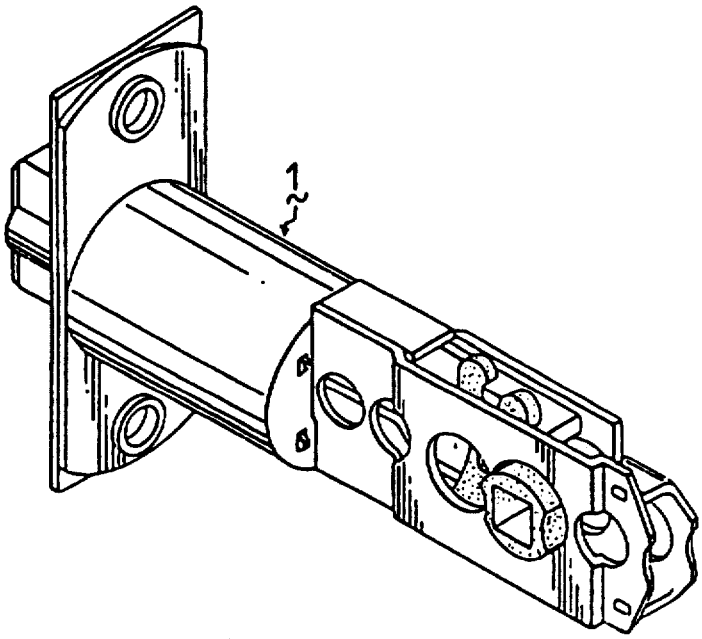
FIG. 1A PRIOR ART
FIG. 1(A) is a perspective view of a known fixed duplex latch-bolt mechanism.
Figure 1B:
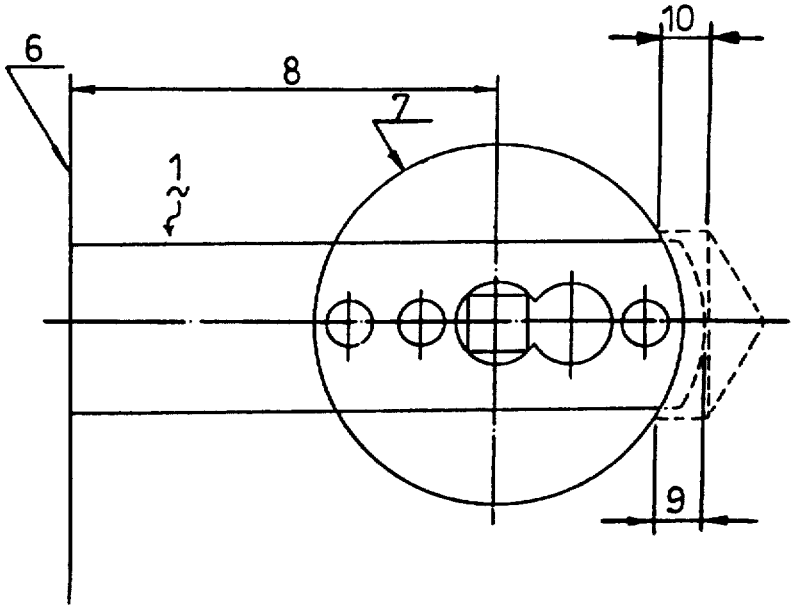
FIG. 1B PRIOR ART
FIG. 1(B) is an illustrative view indicating the installation condition of the known fixed duplex latch-bolt mechanism shown in FIG. 1(A)
Figure 2:
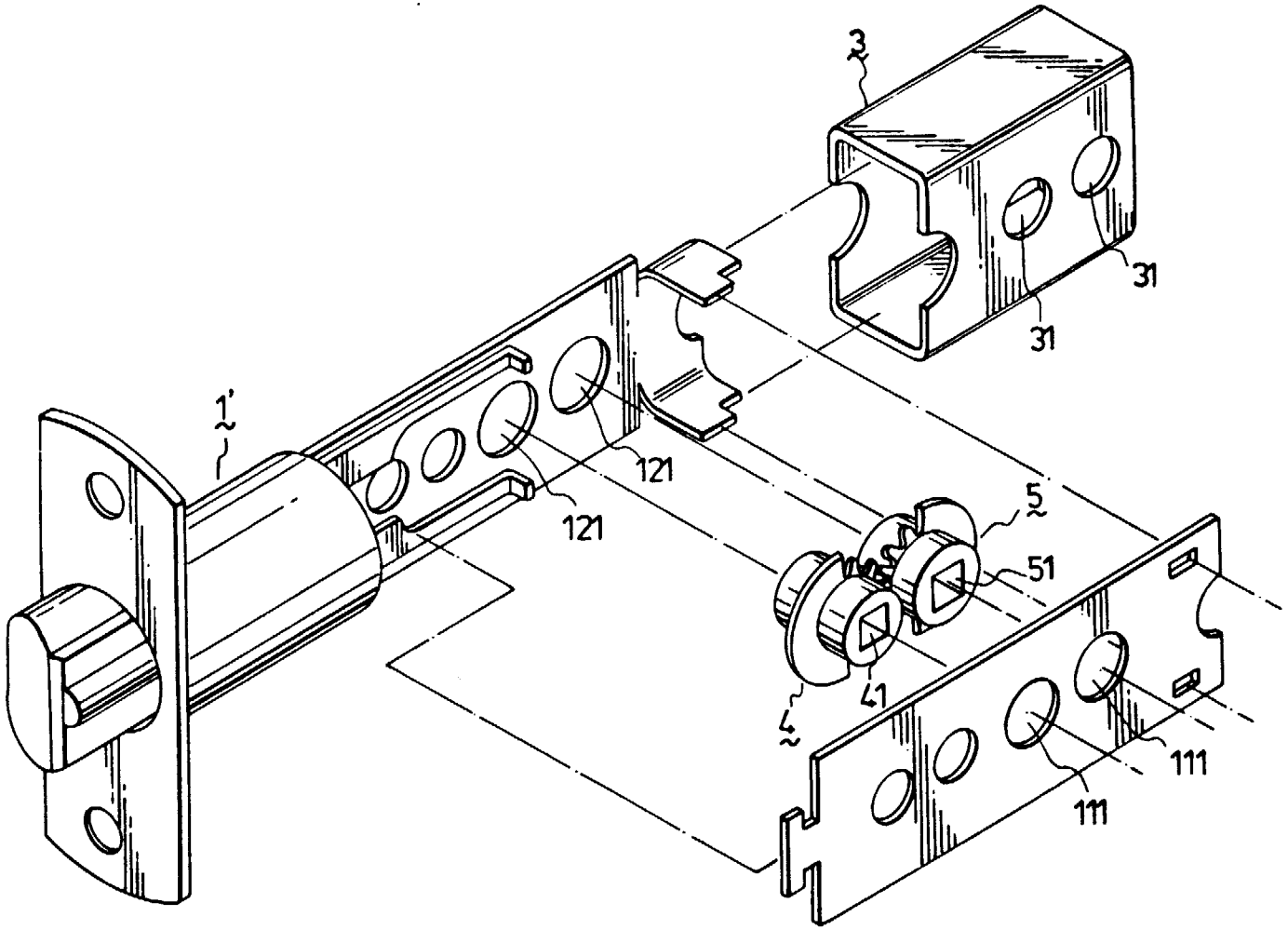
FIG. 2 (PRIOR ART)
FIG. 2 is a perspective and exploded view of a known adjustable duplex latch-bolt mechanism.
Figure 3:
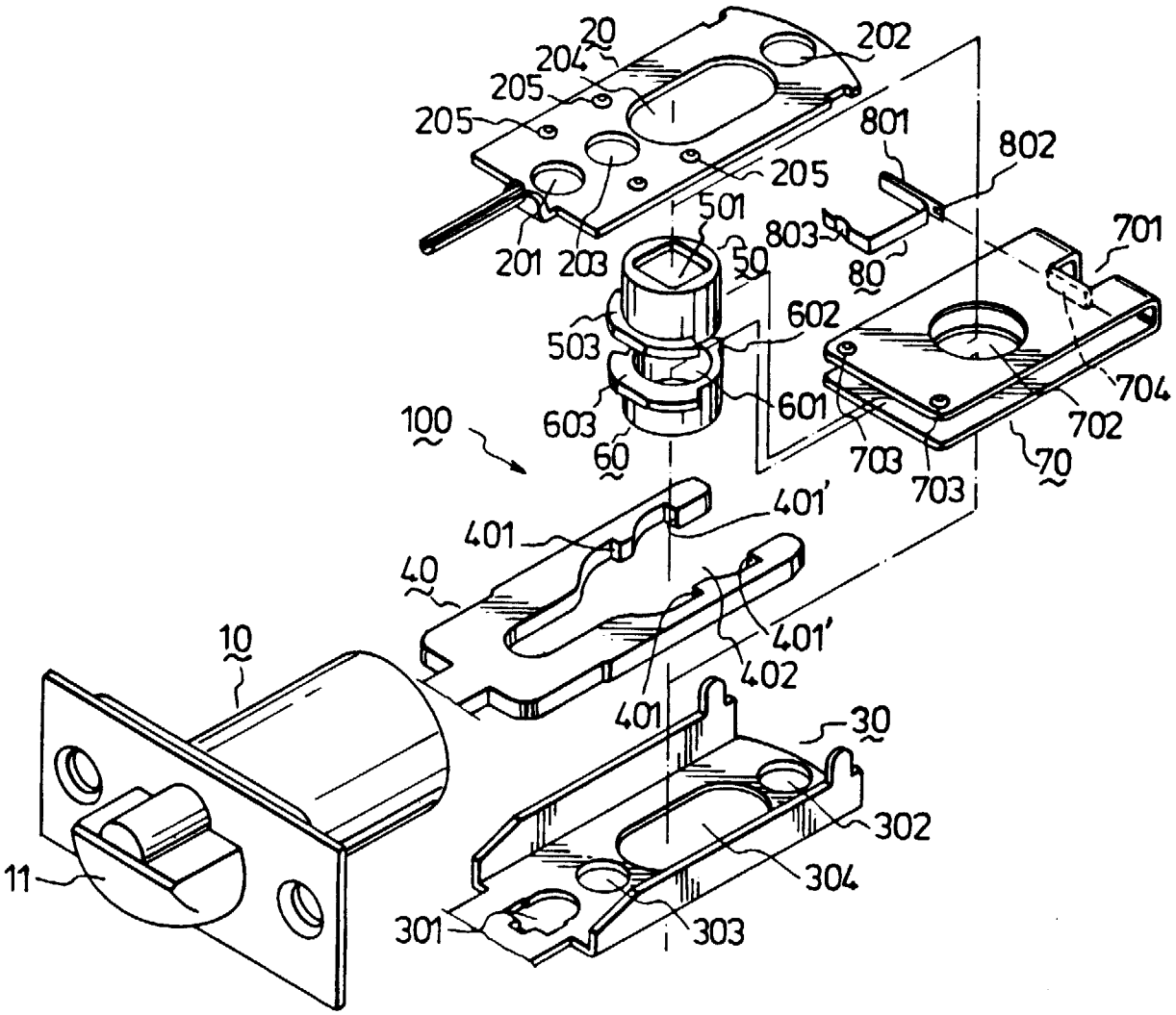
FIG. 3 is a perspective and exploded view of a preferred embodiment of an improved duplex latch-bolt mechanism according to the present invention.

Referring to FIG. 3, a preferred embodiment of an improved duplex latch-bolt mechanism according to the present invention is shown. The preferred embodiment comprises a combination of a latch-bolt head assembly 10 and a latch-bolt transfer device 100 wherein the structure of the latch-bolt head assembly 10 is known in the prior art. Explanation of the latch-bolt head assembly 10 is therefore omitted hereinafter in the interests of simplicity.

The latch-bolt transfer device 100 according to the present invention is composed of an upper coupling member 20, a lower coupling member 30, a bolt extracting member 40, a cam setting means combined of a first cam roller 50 and a second cam roller 60, a displacement means 70 and a transfer locating member 80.

As shown in FIG. 3 with reference to FIGS. 4 and 5, the upper coupling member 20 and the lower coupling member 30 are developed from the first and second coupling members (31, 32) of the U.S. Pat. No. 4,711,477 issued to this applicant for the purpose of being adapted to the preferred embodiment of this application. The plate-like upper coupling member 20 includes: a forward opening 201, a rear opening 202 and a middle opening 203 respectively provided about an axial line therein for selectively receiving the cylindrical support nuts of a latch-handle assembly (not shown) according to the 60 mm and 70 mm door fitting arrangements; an elongated central opening 204 formed between the middle screw opening 203 and the rear screw opening 202 for accommodating the two cam rollers 50 and 60; and a plurality of recess holes 205 symmetrically located on the opposing sides of the said coupling member 20, near the middle opening 203, for achieving a movable positioning effect therewith. The lower coupling member 30 is in the form of an open case with a forward opening 301, a rear opening 302, a middle opening 303 and an elongated central opening 304, respectively corresponding to those openings of the upper coupling member 20.

As shown in FIG. 3 with reference to FIG. 6, the bolt extracting member 40 is also developed on the basis of the bolt retracting member (27) of the U.S. Pat. No. 4,711,477. The main feature of the bolt extracting member 40 includes a pair of forward extraction teeth 401 and a pair of rear extraction teeth 401' symmetrically located along the opposing edges of an elongated open section 402 formed in the middle area of the bolt extracting member 40 in conjunction with the two cam rollers 50 and 60. Against these two pairs of extraction teeth 401, 401' the cam roller 50 or 60 which is adapted to be engaged with a square transfer member or actuator of a latch-handle assembly (not shown), is turned to pull the bolt extracting member 40 which in turn extracts the latch-bolt head 11 (as shown in FIGS. 9, 10, 11 and 12) so as to effect a telescopic operation of the latch-bolt head 11.

Figure 15:
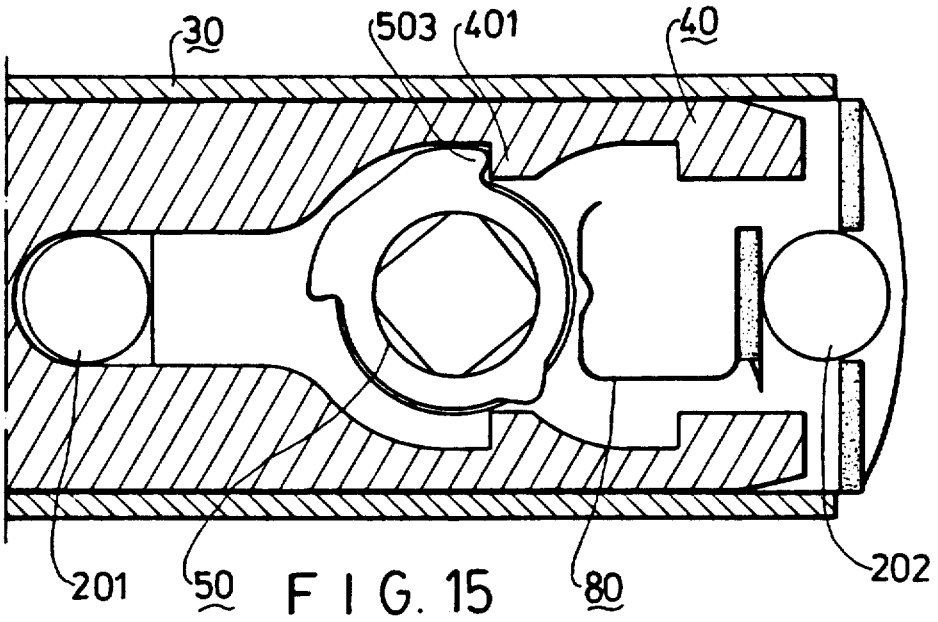
FIG. 15 is a vertical sectional view of the latch-bolt transfer device of the preferred embodiment shown in FIG. 11.
Figure 16A:
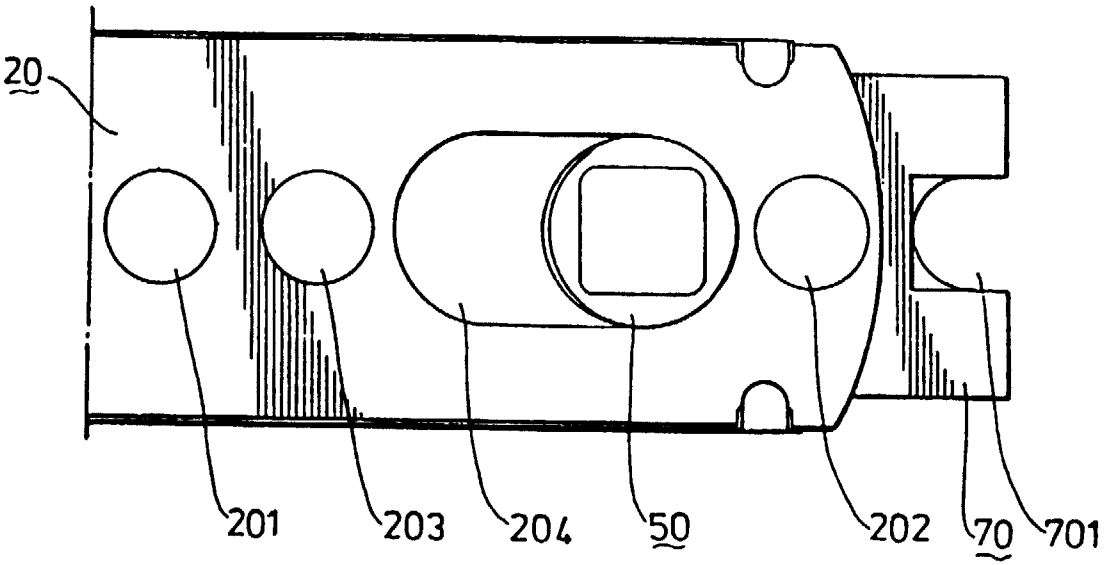
FIGS. 16*a*, 16*b* and 16*c* are respectively plan view, elevation view and side view schematically illustrating the latch-bolt transfer device of the preferred embodiment shown in FIG. 10.
Figure 16C:
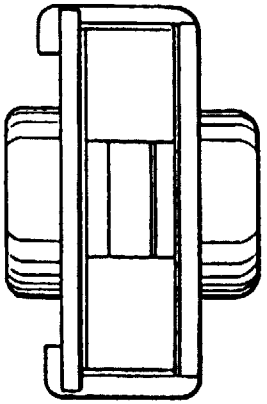
Figure 16B:
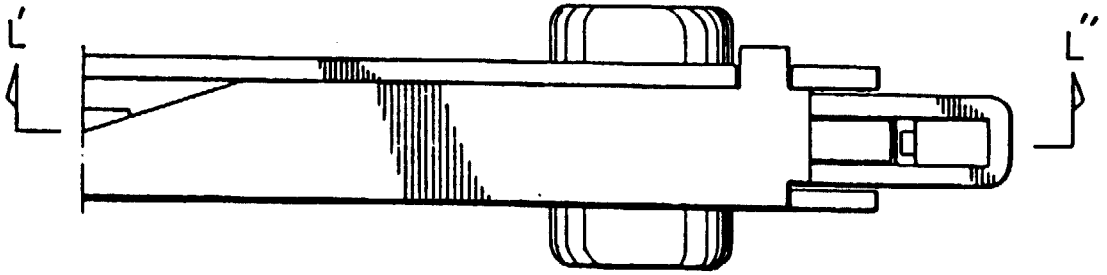

As shown in FIG. 3 with reference to FIG. 7, the cam setting means includes a first cam roller 50 and a second cam roller 60 both of which are designed to engage with a square transfer member or actuator of a known latch-bolt handle assembly (not shown). :Each of the cam rollers 50, 60 includes: a square opening 501 (601) formed in the center thereof for receiving a square transfer member (or an actuator) of a latch-handle assembly (not shown); a cam lobe 502 (602) on one side of said cam rollers 50, 60 for being contacted with the transfer locating means 80 while keeping said cam rollers 50, 60 in a movable position and reducing the friction of said two cam rollers 50, 60 disposed in the open section 402 of the bolt extracting member 40; and a cam flange 503 (603) at another side of cam rollers 50, 60 for being turned to engage with the extraction teeth 401. In this way, when the cam roller 50 or 60 is turned in both directions against the extraction teeth 401 of the bolt extracting member 40 (as shown in FIG. 15), retraction and extention of the latch-bolt head 11 will be effected accordingly.

As shown in FIG. 3 with reference to FIG. 8, the displacement means 70 is formed in an elongated U-jacket and includes: a screw opening 701 located at a closed end thereof for being engaged with a cylindrical support nut of a latch-bolt handle assembly (not shown) when the displacement means 70 is pulled out for a 70 mm door fitting arrangement; a cam through opening 702 in the center thereof for movably receiving one of the cam rollers 50 or 60, (depending on whether a 60 mm or a 70 mm door fitting arrangement is required); and a pair of protuberances 703 symmetrically provided on the opposing inner side of the open end for being movably engaged with either pair of the recess holes 205 of the upper coupling member 20 on a selective basis when the displacement means 70 is adjusted according to the door fitting- arrangement (60 mm or 70 mm). Since the U-shaped jacket of the displacement means 70 is elastic in nature, it can be easily adjusted along the opposing surfaces of the upper coupling member 20 so as to enable the two protuberances 703 to be respectively engaged with the recess holes 205 of the upper coupling member 20 with reduced friction during displacement. In addition, an upward flange 704 is located on one side of the displacement means 70 along an edge of the screw opening 701 for being used to hold the transfer locating member 80 in position thereat As shown in FIG. 3 with reference to FIG. 18, the U-shaped transfer locating member 80 includes a clip 801 formed at one side thereof with a protrusion 802 located at a free end of the clip 801 for being held at an edge of the upward flange 704 being gripped by said clip 801; and a recess 803 provided at another side facing the clip 801 for being movably engaged with either one of the cam lobes 502, 602 of the cam rollers 50, 60.

In assembly operations, the bolt-extracting member 40 is movably fixed to the latch-bolt head assembly 10, (in the same way as that described and illustrated in U.S. Pat. No. 4,711,477), the cam rollers 50, 60 are movably arranged in the open section 402 of the bolt extracting member 40 so that the other cam flang 503, 603 of the cam rollers 50, 60 are located against the forward extraction teeth 401 for the 60 mmm door fitting arrangement, and against the rear extraction teeth 401' for 70 mm door fitting arrangement; the upper and the lower coupling members 20, 30 are connected together around the bolt extracting member 40 with both end portions of the two cam rollers 50, 60 movably received in the cam through openings 204, 304; the displacement means 70 is sleeved unto the upper coupling member 20 with the protuberances 703 movably engaged with the recess holes 205, the central opening 702 located around the upper end portion of the first cam roller 50, the screw opening 701 lined with the rear screw openings 202, 302 of the upper and lower coupling members 20, 30, and the transfer locating member 80 disposed on the displacement means 70 with the clip 801 gripped around the upward flange 704 and checked by the protrusion 802 while the cam lobe 502 is abutted on the recess 803 on one side of the transfer locating member 80. The combined latch-bolt mechanism is adapted to be transversely connected to an ordinary latch-handle assembly (not shown) disposed in a longitudinal opening of a door through a transverse opening communicating with the longitudinal opening in the door and operatively connected with a square transfer member (or actuator) and a plurality of cylindrical support nuts of the latch-handle assembly.

Figure 9:
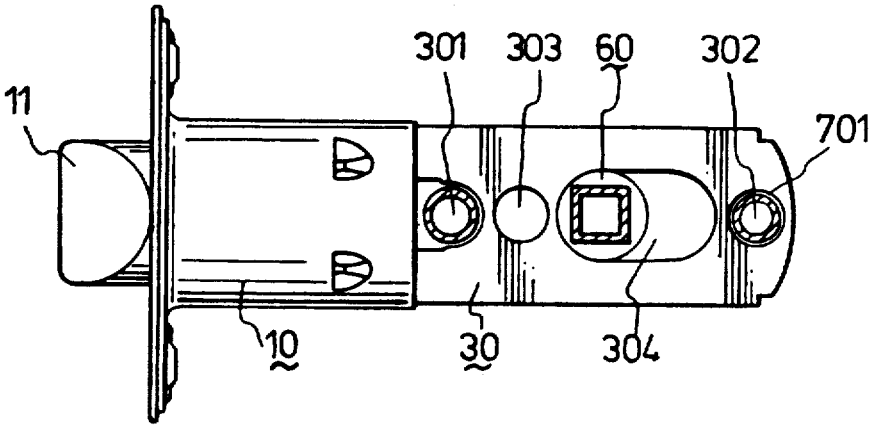
FIG. 9 is an illustration of the preferred embodiment adapted to a 60 mm door fitting arrangement.
Figure 10:
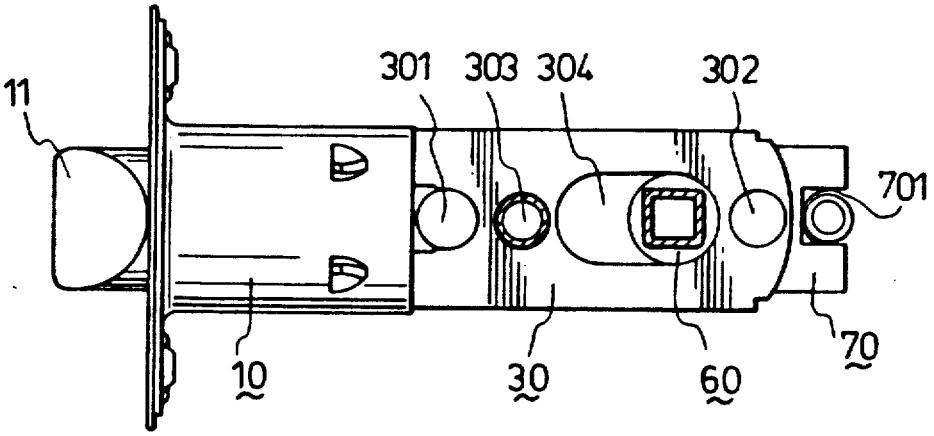
FIG. 10 is an illustration of the preferred embodiment adapted to a 70 mm door fitting arrangement.
Figure 11:
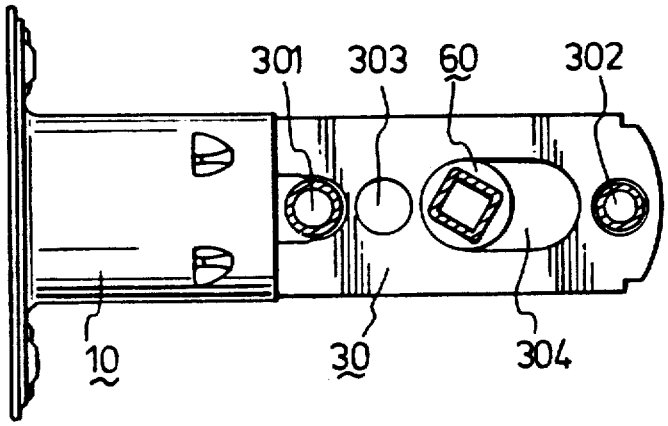
FIG. 11 is an illustration indicating the latch-bolt head of the preferred embodiment shown in FIG. 9 being retracted upon the turning of the bolt actuator of a known latch-handle assembly operatively coupled with the preferred embodiment.
Figure 12:
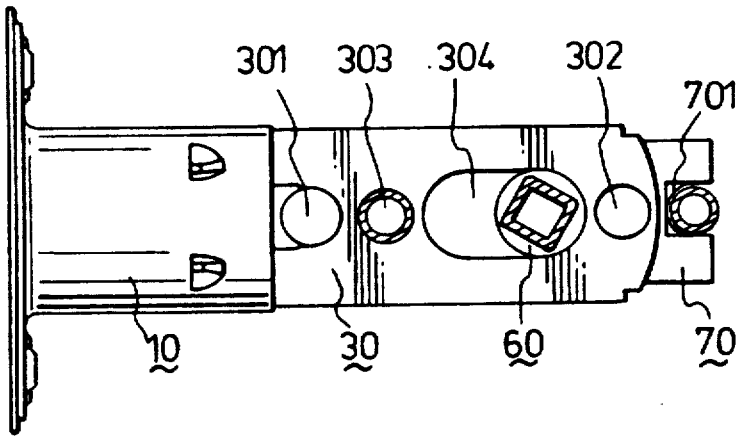
FIG. 12 is an illustration indicating the latch-bolt head of the preferred embodiment shown in FIG. 10 being retracted upon the turning of the bolt actuator of a known latch-handle assembly operatively coupled with the preferred embodiment.
Figure 13C:
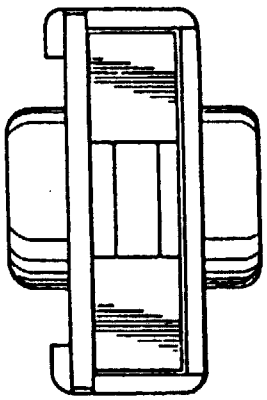
FIGS. 13*a*, 13*b* and 13*c* are the positioning condition of the latch-bolt transfer device of the preferred embodiment shown in FIG. 9.
Figure 13A:
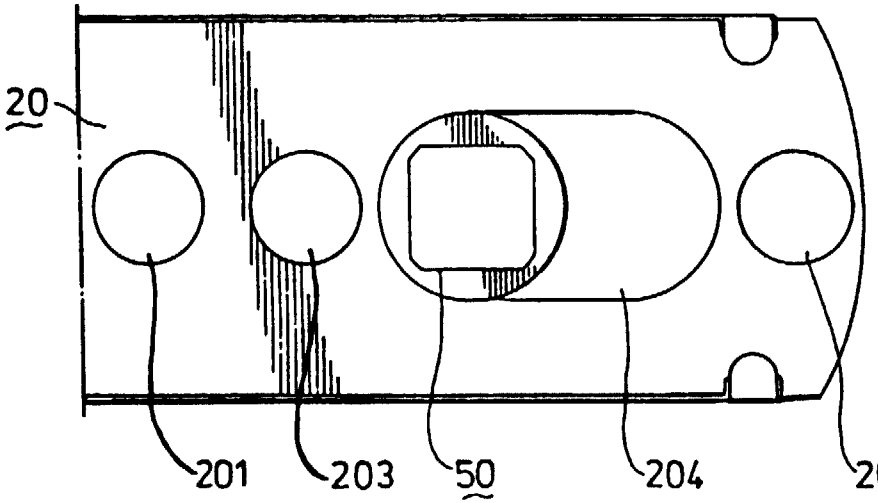
Figure 13B:
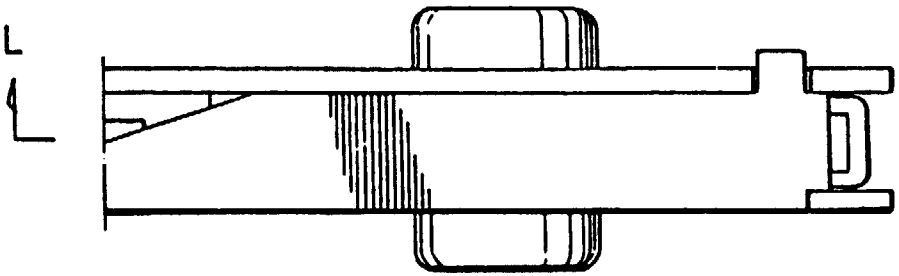

Referring to FIGS. 9, 10, 11, 12, 16 and 17, the primary feature of the present invention lies in the displacement means 70 through which length change of the latch-bolt mechanism 100 can be easily made by either pulling out the displacement jacket 70 to form a 70 mm configuration, as shown in FIGS. 10, 12, 16 and 17, or pushing said displacement jacket 70 back to form a 60 mm configuration as shown in FIGS. 9 and 11. The recess 803 of the transfer locating member 80 engages the cam lobes 502, 602 during movement of the displacement jacket 70, preventing cam rotation and permitting the flange members 503, 603 to pass through the forward teeth 401 without getting snagged.

It shall be appreciated that the square sectional line shown in FIGS. 9, 10, 11 and 12 indicates the position of a known square transfer member or a square actuator of an ordinary latch-handle assembly (not shown) and the round sectional lines shown in the same drawings denote the locations of two cylindrical support nuts fixed in the ordinary latch-handle assembly such as that presented in the U.S. Pat. No. 4,711,477 issued to this applicant. Since the structure and positioning arrangement of the above-mentioned square transfer member and the cylindrical support nuts of the ordinary latch-bolt handle assembly are well known to those skilled in the art, explanation and illustration are omitted for clarity.

Figure 14:
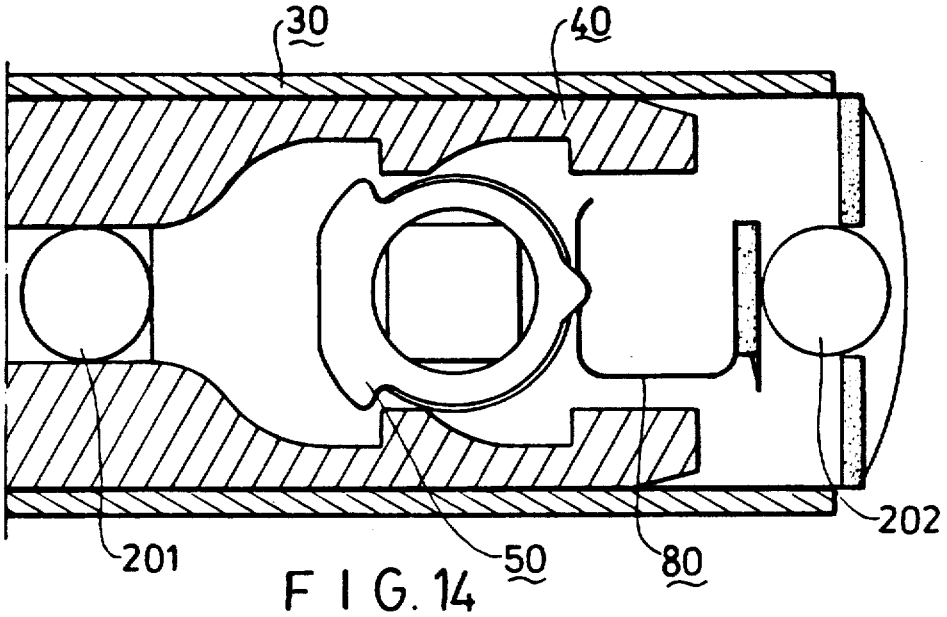
FIG. 14 is a sectional view of the latch-bolt transfer device taken along line L—L' of FIG. 13.

Referring to FIGS. 14 and 15, another feature of the present invention lies in the two cam rollers 50, 60 by which said cam rollers 50, 60 can smoothly turn and mesh with the extracting member 40 without causing much mechanical wear upon the parts thereof.

The description and illustrations of the preferred embodiment presented hereinbefore comprise only one example of the present invention. Various alternative examples of the preferred embodiment can be made simply by modifying the cam rollers 50, 60 and some other components for effecting the same turning movement of the cam rollers and the length adjusting operations of the latch-bolt transfer device as provided by the above-described embodiment.

Figure 19:
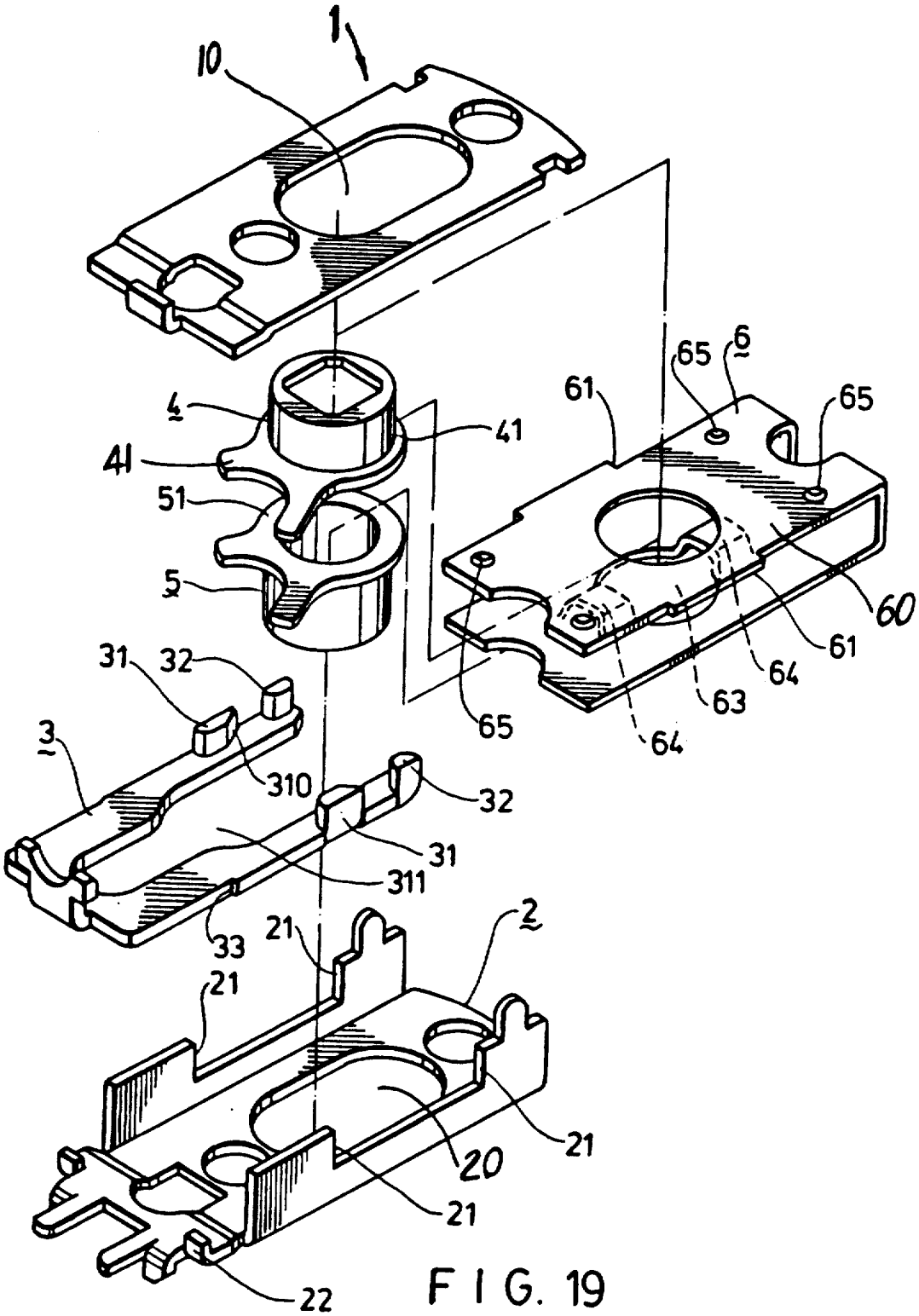
FIG. 19 is a perspective and exploded view of a first alternative example of the preferred embodiment according to the present invention.
Figure 20B:
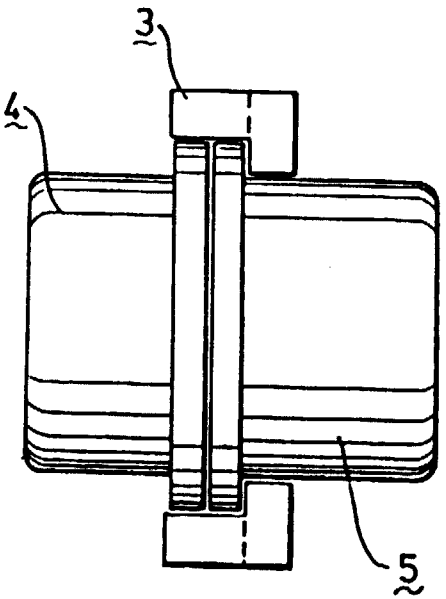
FIGS. 20*a* and 20*b* are respectively plan and side views schematically illustrating the assembled condition of the cam setting means and the bolt extracting member of the preferred embodiment shown in FIG. 19.
Figure 20A:
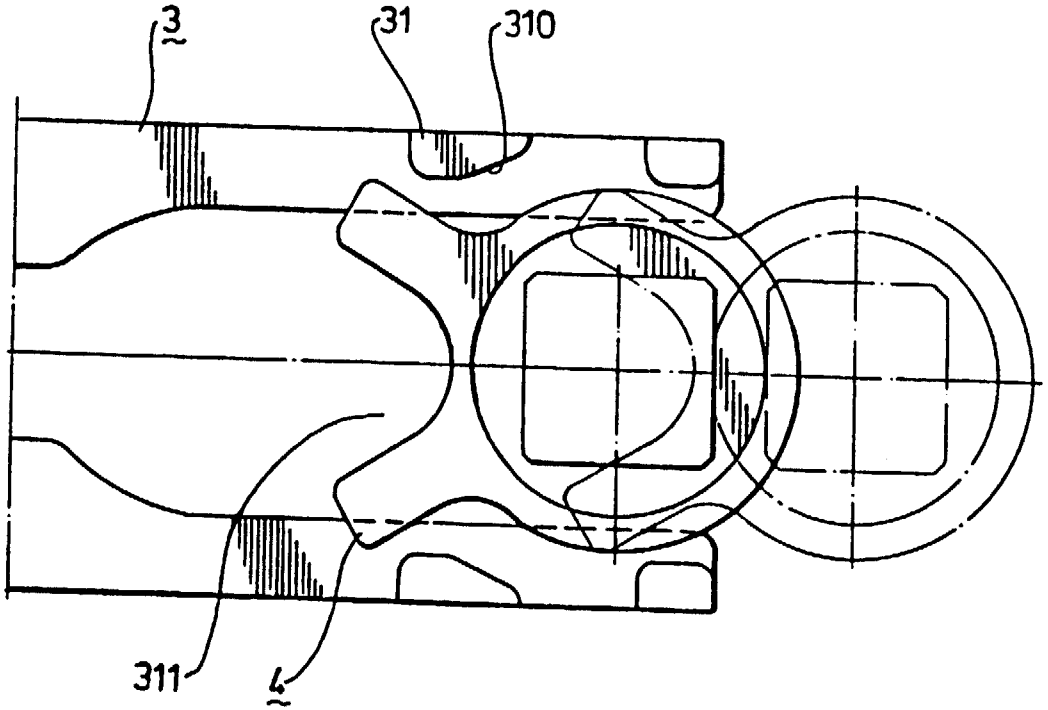

Referring to FIGS. 19 and 20, a first alternative example of the duplex latch-bolt mechanism according to this invention is shown wherein the modifications are made on the lower coupling member 2, the bolt extracting member 3, the cam setting means composed of two cam rollers 4, 5, and the displacement means 6. As shown in FIG. 19, the lower coupling member 2 is formed in an open case and provided with an elongated notch 21 at the opposing sides thereof for receiving an extended flange 61 formed at the opposing edges of the displacement means 6 during displacing operations, and a pair of latch dogs 22 symmetrically located at the front end for engaging with a shoulder 33 formed at the opposing sides of the bolt extracting member 3 during an operational movement of the latch-bolt mechanism. In addition, the bolt extracting member 3 is provided with a pair of forward extraction teeth 31 and a pair of rear extraction teeth 32 vertically formed at the opposing sides of the elongated open section 311 for being movably engaged with cam roller 4 or 5, wherein each one of the forward extraction teeth 31 has a beveled surface 310 at one end for being used to eliminate possible obstruction as well as to reduce the friction caused by the turning movement of cam roller 4 or 5 during operations of the latch-bolt mechanism. Moreover, on the bottom side of the displacement means 6, which is also formed in the shape of an elongated U-shaped jacket, a pair of raised faces 64 are separately provided on the opposing edges of the cam through opening 63 for being used to keep one of the cam rollers 4, 5 in position thereat, and on the top side, a pair of protrusions 65 are symmetrically located on the front end and the rear end for the purpose of reducing friction when the displacement means 6 is adjusted. (It shall be appreciated that since the displacement means 6 is provided with the raised faces 64, the cam 4 or 5 can be movably positioned in the cam through opening 63.) As can be seen from FIG. 19, one end of each one of the two cam rollers 4, 5 is also modified to have a forked flange 41, 51 so as to be movably disposed in the elongated open section 311 of the bolt extracting member 3 as shown in FIG. 20. (It is to be noted that both the assembly and adjustment of this first alternative example of the improved duplex latch-bolt bolt mechanism according to the present invention are the same as that of the preferred embodiment described and illustrated in the foregoing paragraphs.)

Figure 21:
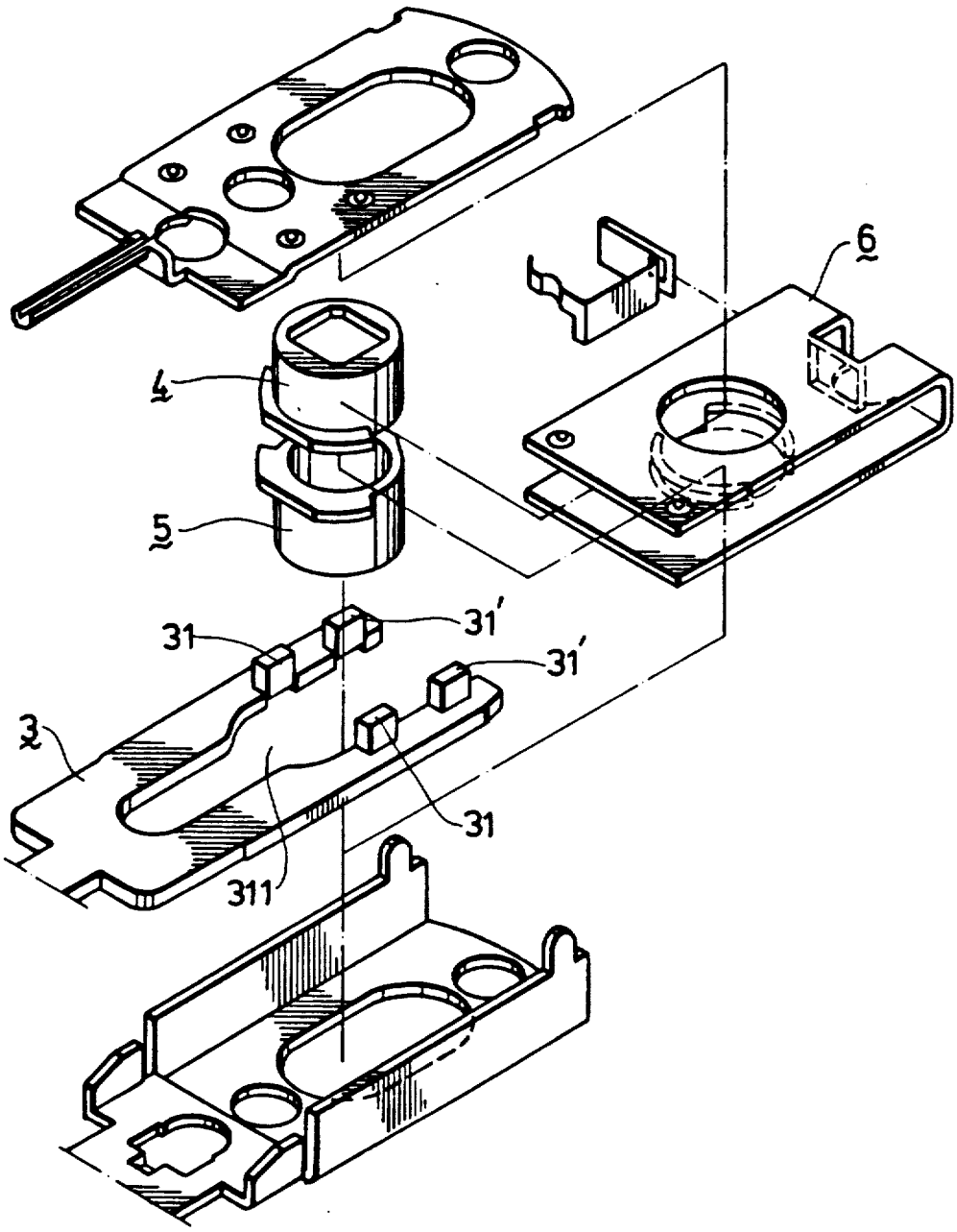
FIG. 21 is a perspective and exploded view of a second alternative example of the preferred embodiment according to the present invention.
Figure 22B:
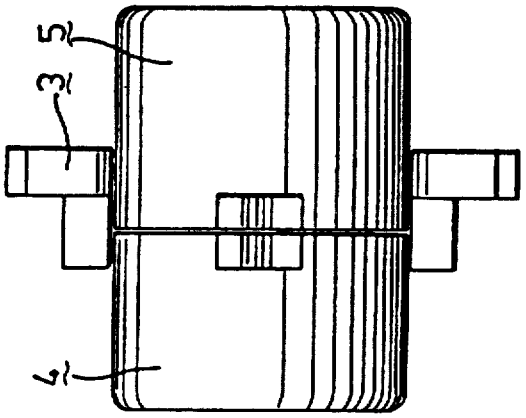
FIGS. 22*a* and 22*b* are respectively plan and side views schematically illustrating the assembled condition of the cam setting means and the bolt extracting member of the preferred embodiment shown in FIG. 21.
Figure 22A:
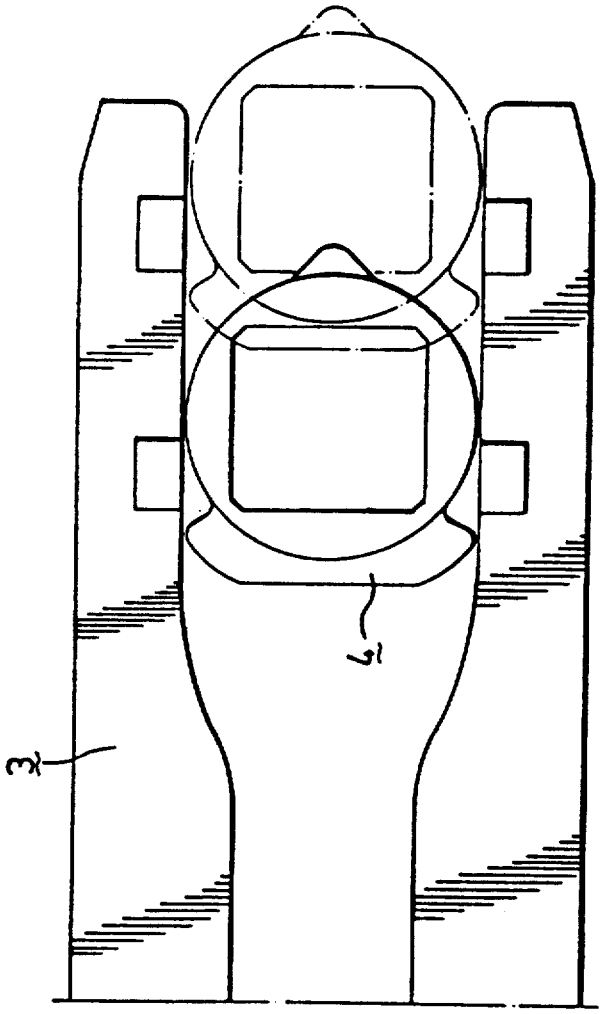

Referring to FIGS. 21 and 22, a second alternative example of the preferred embodiment of the improved duplex latch-bolt mechanism according to the present invention is shown wherein the bolt extracting member 3 is provided with a pair of forward extraction teeth 31 and a pair of rear extraction teeth 31' on one side of the end portion of the open section 311, and each one of the extraction teeth 31, 31' is formed without a beveled surface so as to movably engage with the cam rollers 4, 5 the structure of which are the same as that in the preferred embodiment (as shown in FIG. 3).

Figure 23:
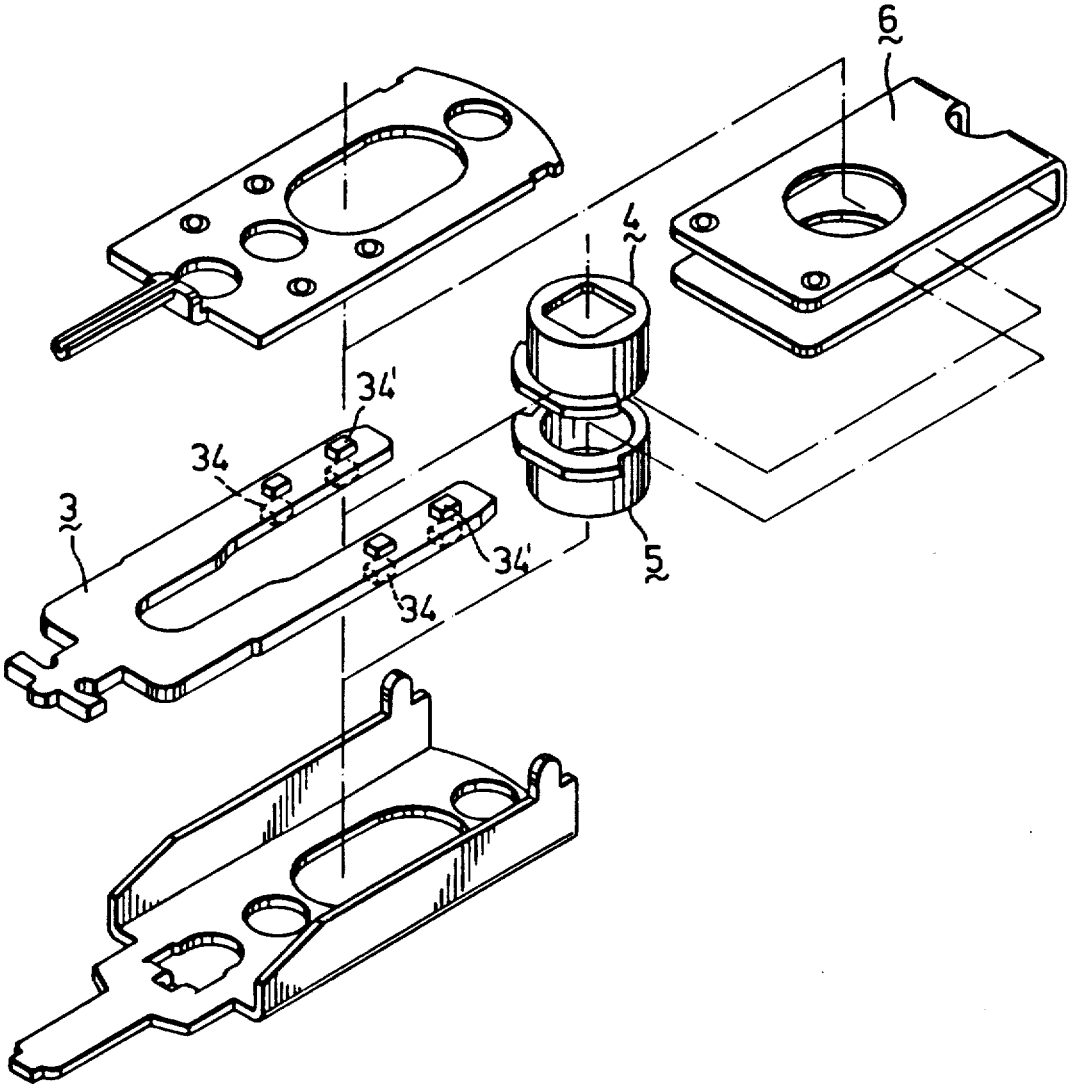
FIG. 23 is a perspective and exploded view of a third alternative example of the preferred embodiment according to the present invention.
Figure 24B:
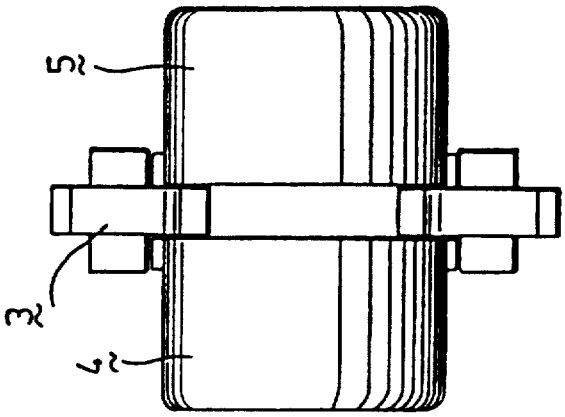
FIGS. 24*a* and 24*b* are respectively plan and side views schematically illustrating the assembled condition of the cam setting means and the bolt extracting member of the preferred embodiment shown in FIG. 23.
Figure 24A:
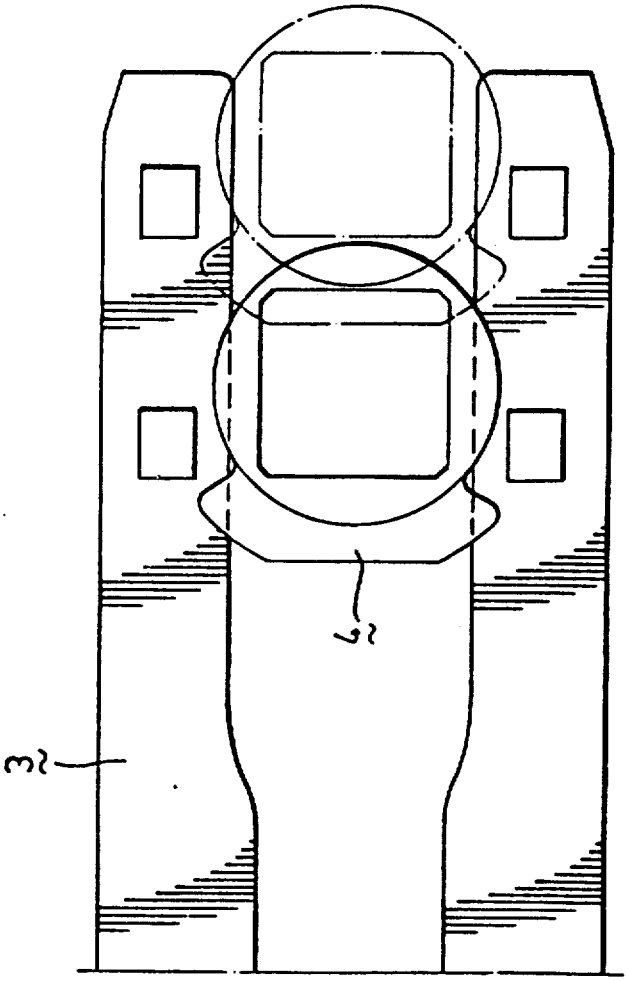

Referring to FIGS. 23 and 24, a third alternative example of the preferred embodiment of the present invention is shown. The modification made in the third alternative example includes two pairs of forward extraction teeth 34 and two pairs of rear extraction teeth 34' symmetrically provided on opposing sides of the end portion of the open section 311 for being movably engaged with the cam rollers 4, 5 which are turned in different directions thereat. Other functions and adjustments of the latch-bolt mechanism of this example are the same as those of the second alternative example described and illustrated above.

Figure 25:
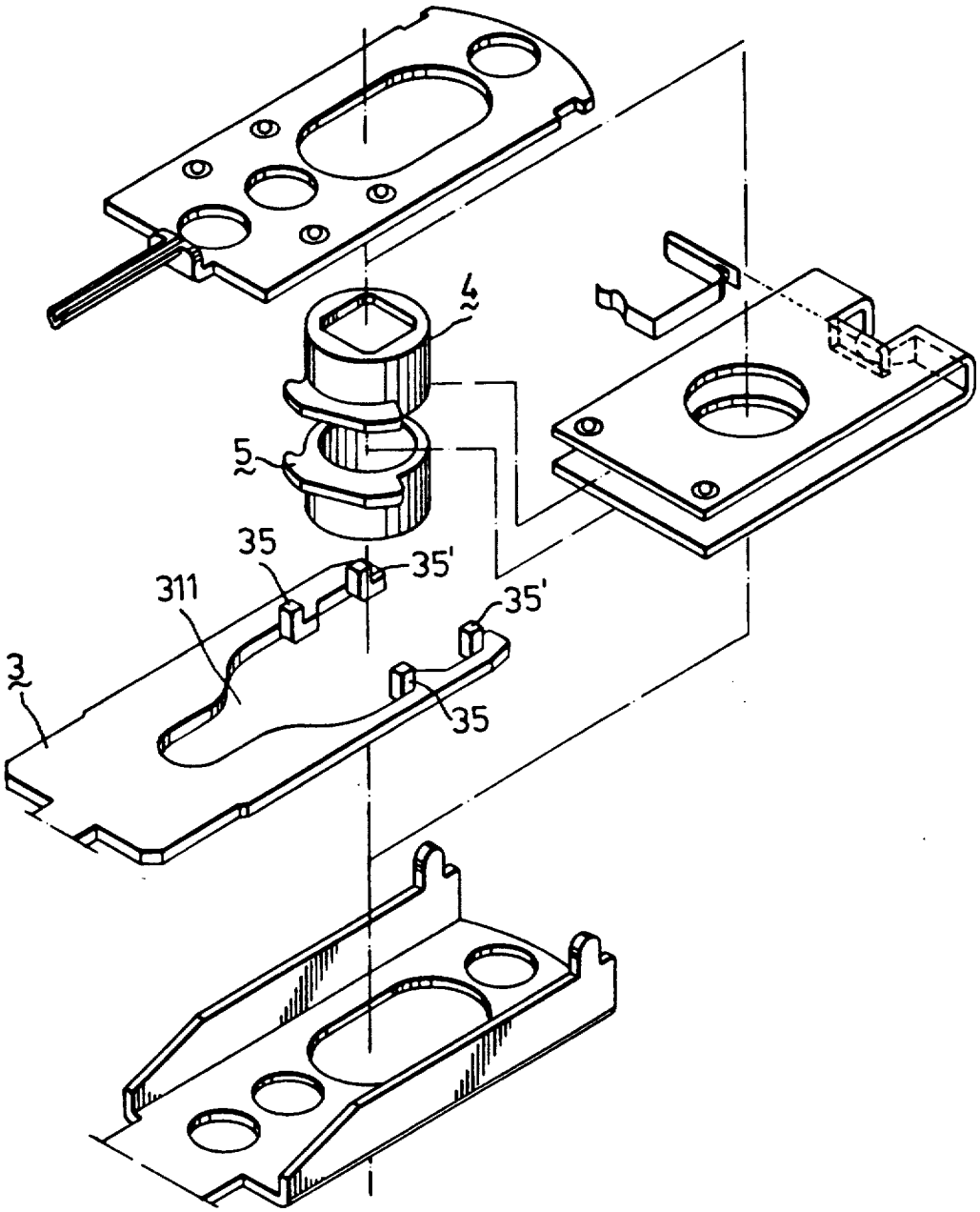
FIG. 25 is a perspective and exploded view of a fourth alternative example of the preferred embodiment according to the present invention.
Figure 26B:
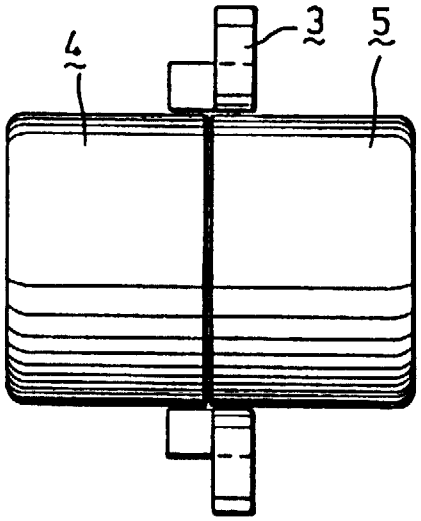
FIGS. 26*a* and 26*b* are respectively plan and side views schematically illustrating the assembled condition of the cam setting means and the bolt extracting member of the preferred embodiment shown in FIG. 25.
Figure 26A:
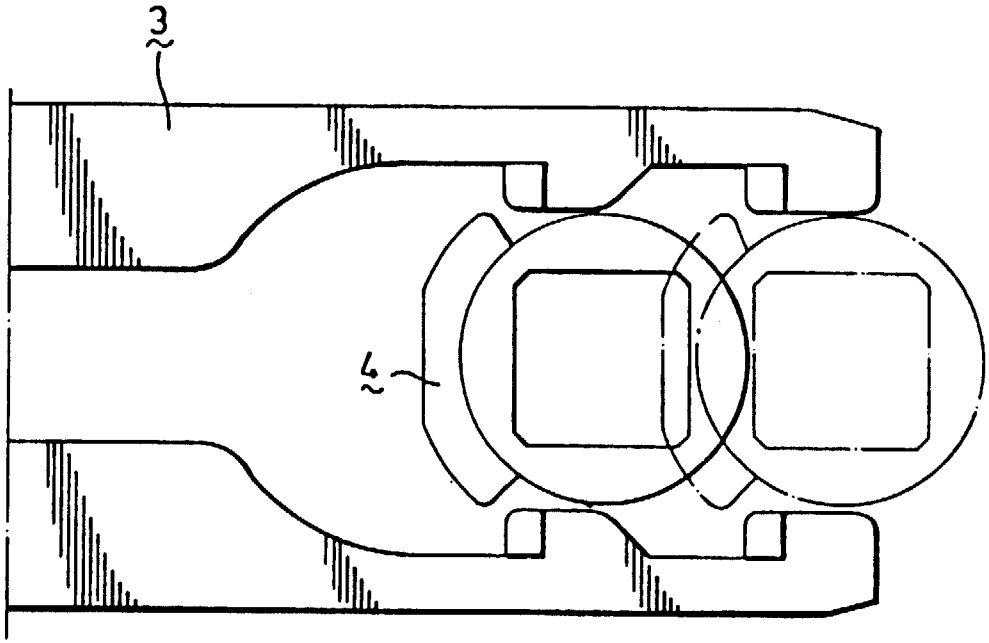

Referring to FIGS. 25 and 26, a fourth alternative example of the preferred embodiment according to the present invention. The modification made in this example includes a pair of upright forward extraction teeth 35 and a pair of upright rear extraction teeth 35' which are symmetrically provided at the opposing edges of the end portion of the open section 311 for being movably engaged with the cam rollers 4, 5 during locking and unlocking operations. The function and adjustment of the this alternative example are the same as those of the preferred embodiment described and illustrated in FIG. 3.

Figure 27:
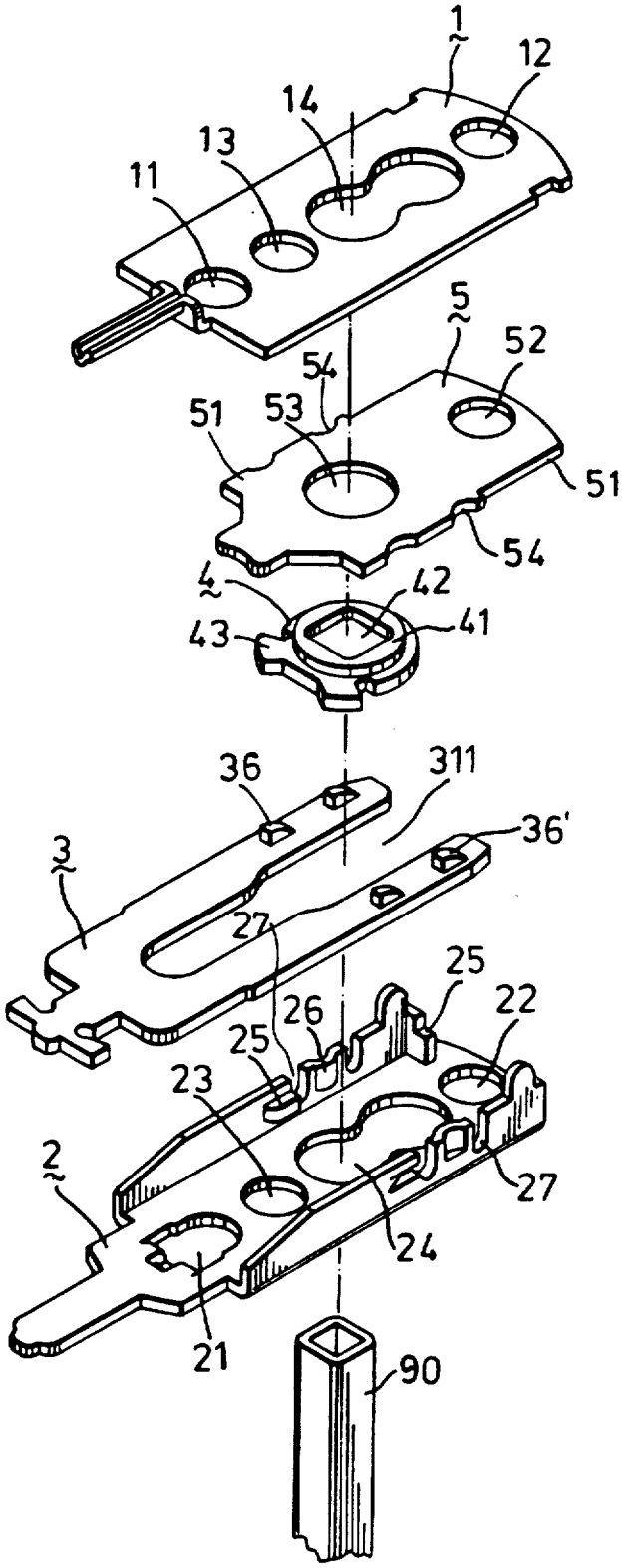
FIG. 27 is a perspective and exploded view of a fifth alternative example of the preferred embodiment according to the present invention.
Figure 28B:
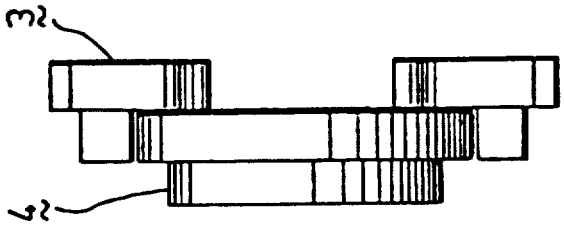
FIGS. 28*a* and 28*b* are respectively plan and side views schematically illustrating the assembled condition of the cam setting means and the bolt extracting member of the preferred embodiment shown in FIG. 27.
Figure 28A:
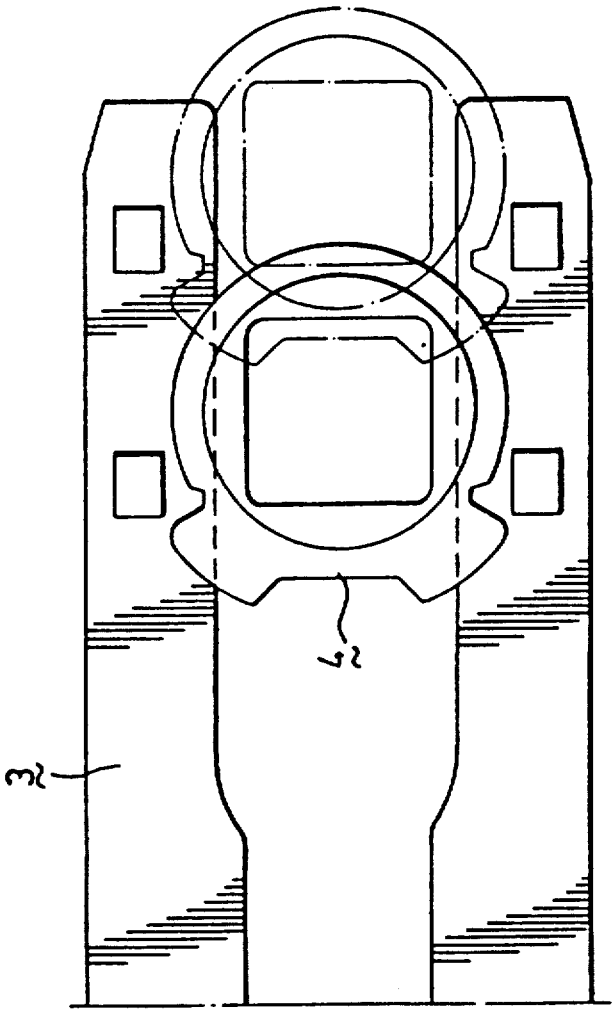

Referring to FIGS. 27 and 28, a fifth alternative example of the preferred embodiment according to the present invention is shown. In this example, only one cam roller 4 is used and a single piece of displacement means 5 is provided without requiring the transfer locating member. Except for the forward, middle and rear screw openings 11, 12, 13, 21, 22, 23 and the cam through openings 14, 24, respectively provided in the upper and lower coupling members 1, 2, the lower coupling member 2 is also provided with a loading area 25 formed on each side and a plurality of positioning protrusions 26 and a holding slot 27 separately located at the opposing sides for superimposing the displacement plate 5 on the lower coupling member 2. The bolt extracting member 3 includes a pair of forward extraction teeth 36 and a pair of rear extraction teeth 36' symmetrically located on one side of the end portion of the open section 311 with both the forward and rear extraction teeth 36, 36' being chamfered on the rear end for effecting smooth operations therewith. The displacement means 5 also includes: forward and rear side walls 51 separately formed on opposing sides thereof for being located on the loading area 25 of the lower coupling member 2; forward and rear notches 54 symmetrically provided on the opposing sides thereof for being movably engaged with the positioning protrusions 26 of the lower coupling member 2; as well as a screw opening 52 and a cam through opening 53 for being adjustably aligned with the cam through opening 24 and the screw opening 22 of the lower coupling member 2. The cam roller 4 includes: a square opening 42, (for being engaged with a square transfer member 90 of an ordinary latch-handle assembly), formed in the center of a round stem 41 which is movably engaged with the cam through opening 53 of the displacement plate 5; and a forked flange 43 provided at one end for being operatively engaged with either the forward or the rear teeth 31*a* located on the bolt extracting member 3 depending upon the position of the displacement plate 5.

The foregoing is considered as illustrative only of the principles of the invention. Furthermore, since numerous modifications and changes will readily occur to those skilled in the art, it is not desired that the invention be limited to the exact construction and operations shown and described herein. Accordingly all suitable modifications and equivalents fall within the scope of the invention as claimed in the appending claims.

What is claimed is:

1. An improved duplex latch-bolt mechanism for use with a latch-handle assembly having a transfer member, the latch-bolt mechanism comprising:

a latch bolt head assembly having a housing and a movable latch bolt therein;

a pair of spaced-apart coupling plate members (10,20) coupled at respective front end regions to the latch bolt head assembly housing, the coupling plate members each having an elongated backset opening;

a bolt-extracting member (3) coupled to the latch bolt for movement frontwards and rearwards therewith, the bolt-extracting member being movably disposed between the coupling plate members for moving the latch bolt, the bolt-extracting member having a central open region (311) and front and rear extraction teeth means (31,32);

a generally U-shaped displacement means (6) having first and second generally plate-like members with mutually aligned through-openings (63), the bolt-extracting member (3) being slideable disposed between the plate-like members, the plate-like members being slidably disposed between the coupling plate members (10,20)

rotary cam means (4,5) mounted for rotation generally co-axially within said through-openings and having generally radially protruding surface means (41,51) positioned to engage a selected one of the front and rear extraction teeth means upon rotation of the rotary cam means to move the bolt-extraction member and thereby cause movement of the latch bolt, the rotary cam means being movable frontwards and rearwards within the central open region (311) of the bolt-extracting member by the displacement means (6) to be engagable with the selected one of the front and rear extraction teeth means, the rotary cam means being adapted for coupling to the transfer member of the latch handle assembly for responsive rotational movement therewith.

2. The latch bolt mechanism of claim 1 wherein the displacement means (6) includes guiding surface means (64) adjacent at least one of the mutually aligned through-openings (63) to bear against the rotary cam means for proper orientation with respect to the extraction teeth means.

3. The latch bolt mechanism of claim 2 wherein the guiding surface means comprises a pair of surface members at diametrically opposite positions about the rotary cam member.

4. The latch bolt mechanism of claim 3 wherein the surface members are between the plate-like members of the displacing means (6).

5. The latch bolt mechanism of claim 1 wherein the front extraction teeth means includes a pair of protrusion members separated by the central open region (311) of the bolt-extracting means(3), and extending partially between the plate-like members of the displacement means (6).

6. The latch bolt mechanism of claim 5 wherein the protrusion members have beveled faces (310) which generally face each other across the central open region (311) of the bolt extracting member (3), the beveled faces diverging from each other as they extend rearwardly so as to guide the radially protruding surface means of the cam means past front excitation teeth means during movement of the cam means from the position in which it engages the rear extraction teeth means to the position in which it engages the front extraction teeth means.

* * * * *